US008580716B2

(12) United States Patent
Ma et al.

(10) Patent No.: US 8,580,716 B2
(45) **Date of Patent: *Nov. 12, 2013**

(54) OVERBASED MAGNESIUM OXIDE DISPERSIONS

(75) Inventors: Qinggao Ma, Naugatuck, CT (US); Cyril A. Migdal, Pleasant Valley, NY (US); Kirk A. Schlup, Woodbury, CT (US); John-Louis DiFlavio, Toronto (CA); Ronald J. Muir, Stouffville (CA)

(73) Assignee: Chemtura Corporation, Middlebury, CT (US)

( * ) Notice: Subject to any disclaimer, the term of this patent is extended or adjusted under 35 U.S.C. 154(b) by 209 days.

This patent is subject to a terminal disclaimer.

(21) Appl. No.: 13/167,127

(22) Filed: Jun. 23, 2011

(65) Prior Publication Data

US 2012/0015853 A1 Jan. 19, 2012

Related U.S. Application Data

(60) Provisional application No. 61/364,130, filed on Jul. 14, 2010.

(51) Int. Cl.
*C10M 169/04* (2006.01)
*C10M 159/24* (2006.01)
*C10M 169/00* (2006.01)

(52) U.S. Cl.
USPC ..... 508/154; 508/391; 508/523

(58) Field of Classification Search
USPC ..... 508/460, 523, 154; 44/373
See application file for complete search history.

(56) References Cited

U.S. PATENT DOCUMENTS

| | | | | |
|---|---|---|---|---|
| 4,056,479 | A | 11/1977 | Redmore et al. | |
| 4,129,589 | A | 12/1978 | Eliades et al. | |
| 4,163,728 | A | 8/1979 | Cheng et al. | |
| 4,293,429 | A * | 10/1981 | Cheng et al. | 508/178 |
| 4,931,164 | A | 6/1990 | Dickakian | |
| 5,759,714 | A | 6/1998 | Matsufuji et al. | |
| 6,197,075 | B1 * | 3/2001 | Muir et al. | 44/373 |
| 2009/0035646 | A1 | 2/2009 | Mikhaylik et al. | |
| 2013/0005620 | A1 * | 1/2013 | Ma et al. | 508/178 |

FOREIGN PATENT DOCUMENTS

| | | |
|---|---|---|
| GB | 1 570 909 | 7/1980 |

* cited by examiner

*Primary Examiner* — Prem C Singh
*Assistant Examiner* — Francis C Campanell
(74) *Attorney, Agent, or Firm* — Joseph Suhadolnik; Chemtura Corporation

(57) ABSTRACT

Overbased MgO dispersions with high magnesium content and acceptably low viscosities are reproducibly prepared without gel formation by heating to 280-360° C. a mixture of MgO, selected dispersants, low MW carboxylic acids, water and a combination of high boiling hydrocarbon and organic diluent, wherein water is more than 8%, typically more than 10% of the reaction mixture. No additional solubilizing or dispersing agents, promoters or reactants such as carbon dioxide, amines, alcohols etc are needed to obtain the desired dispersions. Compositions such as lubricating oils and fuels containing the overbased magnesium dispersions as additives are also disclosed.

5 Claims, No Drawings

OVERBASED MAGNESIUM OXIDE DISPERSIONS

This application claims benefit under 35 USC 119(e) of U.S. Provisional Application No. 61/364,130, filed Jul. 14, 2010, the disclosure of which is incorporated by reference.

Flowable compositions comprising stable dispersions of overbased magnesium oxide with high magnesium content are prepared by heating a mixture of magnesium oxide, sulfonic or carboxylic acid dispersant such as an alkylbenzene sulfonic acid, $C_{1-5}$ carboxylic acid, water and optionally an organic solvent such as xylene or mesitylene, to 280-360° C. in a high boiling hydrocarbon carrier.

BACKGROUND OF THE INVENTION

Petroleum fuels such as residual fuel oils contain large amounts of impurities which result in corrosive deposits in the equipment. For example, crude oil usually contains 1-500 ppm of vanadium in the form of a porphyrin complex depending on the source. Because of its origin as a concentrate from the refining process, residual oil contains several times more vanadium than the crude from which it was derived. The combustion of these vanadium-containing fuels produces very corrosive deposits which can destroy a metal part, such as a gas turbine blade, in a matter of hours.

The presence of sodium in fuel can also have catastrophic consequences. For example, in maritime use the sodium level can be increased because of the introduction of sodium chloride through the air intake and contamination of the fuel by sea water. During combustion, the sodium can react with sulfur in the fuel to form a sulfate which is deposited in turbine parts.

Overbased detergents, e.g., overbased alkaline metal or alkaline-earth metal compounds, are well known additives for lubricating oil compositions and petroleum fuels. These detergents perform a variety of functions including anti-corrosion, deposit control, acid scavenger functions and in general comprise overbased metal compounds complexed with an organic dispersant. For example, overbased magnesium compounds complexed with sulfonate and carboxylate dispersants, have long been used as anti-corrosion and acidic neutralization additives for lubricating oils and greases, anti-corrosion and acidic neutralization additives during the combustion of fuels such as residual fuel, pulverized sulfur-containing coal, corrosion inhibitors in fuels containing vanadium etc. The addition of overbased magnesium detergents to, for example, boiler fuels or gas turbine fuels, is known to reduce corrosion, presumably by forming magnesium complexes with the vanadium or sodium.

Overbased metal detergents are also added to lubricating oils to prevent or remove deposits of oil-insoluble sludge, varnish, carbon and lead compounds which otherwise form on internal combustion engine parts and for combating severe rust conditions which may be encountered during shipping or storage of machinery or exposure to out-door weather. Detergent additives for automotive and diesel engine oils also react chemically with the highly acidic by-products of combustion that find their way into the lubricating oil system.

Often, overbased metal additives are added as a dispersion in an appropriate carrier, in the case of lubricants and fuels, a high boiling liquid hydrocarbon is often used. Obviously the dispersion must be stable during storage and the overbased metal must stay well dispersed in the lubricant or fuel.

A variety of parameters will affect the stability and activity of these dispersions such as the dispersants and carriers employed, particle size of the solid components, and the relationship between metal and dispersant. The process by which the overbased metal compounds and complexes are prepared will greatly influence the actual physical make up and properties of the overbased metal dispersion, impacting particle size and distribution of the metal compound throughout the dispersion, the viscosity and stability of the dispersion, the amount of the metal within the dispersion etc.

U.S. Pat. No. 4,163,728, incorporated herein in its entirety by reference, discloses stable, fluid magnesium-containing dispersions prepared by the high temperature decomposition of magnesium salts of carboxylic acids to MgO in a dispersant-containing fluid. In the process, $Mg(OH)_2$, an organic carboxylic acid or sulfonic acid surfactant such as naphthenic acid, acetic acid and water are heated in a high boiling hydrocarbon to temperatures up to 350° C., which is above the decomposition point of magnesium acetate, 323° C. It is believed that magnesium acetate is formed in situ and decomposes at the high temperatures used. Water is also removed at the elevated temperatures.

U.S. Pat. No. 4,293,429, incorporated herein in its entirety by reference, discloses a variation of U.S. Pat. No. 4,163,728 which begins with MgO instead of $Mg(OH)_2$. In the process, the bulk MgO is converted to magnesium acetate which forms suspended MgO particles of less than 5 microns, and preferably less that 1 micron. Thus, the coarse MgO particles are converted into a dispersion of stabilized micro MgO particulates. It is also disclosed that similar processes using lower temperatures fail to provide the fine particle size MgO. Dispersions with 1-32% magnesium are disclosed and stable dispersions with 19.5% magnesium are exemplified. However, the use of the high boiling hydrocarbon solvent can lead to thick, viscous reaction mixtures making appropriate mixing difficult.

U.S. Pat. No. 4,056,479, incorporated herein in its entirety by reference, discloses a fuel additive for reducing sediment in vanadium-containing fuels comprising a magnesium-alkoxide-carbonate complex in combination with an oil soluble sulfonate and a carboxylate and/or phenate dispersing agent. While the additive of U.S. Pat. No. 4,056,479 has a magnesium content of about 12.5% to about 14.6%, it also tends to have undesirably high viscosities.

U.S. Pat. No. 4,129,589, incorporated herein in its entirety by reference, discloses a process for preparing an over-based oil-soluble magnesium salt of a sulfonic acid by contacting carbon dioxide gas with a mixture comprising an oil-soluble magnesium salt of a sulfonic acid, magnesium oxide, a promoter system comprising a carboxylic acid of 1 to 5 carbons, water, optionally a low MW alcohol and an inert solvent for lowering the viscosity of said mixture to facilitate mixing. The products of U.S. Pat. No. 4,129,589 had acceptably low viscosity and the use of the diluent provides for good mixing and reproducible reaction conditions, but the magnesium content was typically 9-10% and no more than 14%.

U.S. Pat. No. 4,931,164, incorporated herein in its entirety by reference, discloses that treating a low (up to about 1% by weight) asphaltene, low aromatic hydrocarbon liquid with an overbased magnesium sulfonate reduced limited asphaltene fouling. However, in fuel oils, such as residual fuel oils, containing both high asphaltenes (at least more than 1%, and generally at least 3 to 4% by weight) and highly overbased magnesium sulfonates would, under certain conditions, particularly with water present, produce deposits or sediment containing both magnesium and asphaltenes which could plug fuel filters.

U.S. Pat. No. 6,197,075, incorporated herein in its entirety by reference, discloses an overbased magnesium sulfonate, carboxylate or phenate product containing at least 14% and up to about 18% by weight of magnesium, and a succinic anhydride and lower carboxylic acid co-promoter reaction product, useful as a deposit control additive for residual fuel oils and turbine fuels, particularly those containing high asphaltenes without clogging filters and which also reduces vanadium caused corrosion in the turbine. The process for preparing the overbased magnesium product comprises contacting a mixture of i) a sulfonic acid, phenol or carboxylic acid or salt thereof, ii) a magnesium oxide, iii) a co-promoter comprising a lower carboxylic acid, a lower alcohol, a succinic anhydride and water, and iv) a solvent and/or oil, with an acidic gas such as carbon dioxide at 50° F. up to the reflux temperature of the mixture to overbase the reaction mixture. The succinic anhydride may be added prior to, during or post carbonation.

The overbased metal compositions described above and elsewhere are best described as products by process as there is typically no simple chemical formula which adequately correlates to the essential material makeup and the physical properties of the product. Often, the molecular structures of the metal complexes are not fully known and are not a critical aspect of the invention. For example, two compositions containing compounds with the same chemical formula in the same amounts and differing only by the manner in which they were prepared can have very different physical properties.

Attempts to modify known procedures to obtain overbased detergents with certain desired characteristics of the final dispersion, e.g., high metal content or low viscosity, have met with unforeseen drawbacks. For example, attempts to facilitate mixing during preparation and obtain a lower viscosity product by adding a diluent solvent to the mixture of MgO, dispersant, water, acetic acid and high boiling hydrocarbon of U.S. Pat. No. 4,293,429, and then heating as described in the Examples therein, lead on many occasions to the formation of a gel and not the desired free flowing dispersion. Thus, a new, readily controlled and reproducible process for preparing stable overbased magnesium dispersions with high levels of magnesium and usable viscosities as an additive in fuels and lubricating oils is desirable.

SUMMARY OF THE INVENTION

It has been found that stable overbased MgO dispersions with high magnesium content and acceptably low viscosities can be conveniently and reproducibly prepared without gel formation by heating to 280-360° C. a mixture of MgO, selected dispersants, low MW carboxylic acids and water in a high boiling hydrocarbon carrier, wherein water is at least 8% and typically at least 10% by weight of the reaction mixture. No additional solubilizing or dispersing agents, promoters or reactants such as carbon dioxide, amines, alcohols etc are needed to obtain the desired dispersions.

Magnesium oxide dispersions with up to 40 weight % magnesium, based on the total weight of the dispersion, can be prepared, for example, magnesium contents of 10%, 15%, 20%, 30% and higher are obtained. As stated before, a specific chemical formula for the composition of the dispersion is not fully descriptive of the product, and the molecular structures of the magnesium complexes of this invention are not fully known, however, the product obtained is a free flowing dispersion of predominately submicron MgO particles engulfed by and complexed to a sulfonate or carboxylate dispersant. Other magnesium compounds such as traces of magnesium hydroxide are also believed to be present.

The overbased magnesium containing dispersion can be used as an additive in fuels, lubricating oils, for example, petroleum based fuels and lubricants, anti corrosive paints and as part of any formulation containing similar materials.

DESCRIPTION OF THE INVENTION

The invention provides a composition useful as an additive in lubricating oils or petroleum fuels, the composition being a stable flowable overbased magnesium oxide dispersion in a high boiling hydrocarbon carrier with a magnesium content of 10-40%, and typically higher than 14%, for example 15-40%, 15-35%, 20-40% or 25-35%, by weight based on the total weight of the composition, prepared by first heating at reflux in a high boiling hydrocarbon carrier, and optionally a lower boiling inert organic solvent, a mixture of magnesium oxide, water, a sulfonic or carboxylic acid dispersant such as an alkylbenzene sulfonic acid, a $C_{1-5}$ carboxylic acid, wherein the dispersant and $C_{1-5}$ carboxylic acid are present in less than one molar equivalent relative to the magnesium oxide, followed by heating to 280-360° C. with removal of water, wherein the reaction mixture before heating contains more than 8% and typically at least 10% by weight of water based on the total weight of the reaction mixture.

In preparing the magnesium oxide dispersion, no acidic gas is passed through the mixture of MgO, dispersant, carboxylic acid, water, diluent and carrier. While alcohols are known as promoters in similar processes, it is found that their presence in the instant process is not necessary and may slow the reaction if present in appreciable amounts. For example, in many of embodiments of the invention, the reaction is carried out in the presence of less than 10% by weight of components other than the MgO, dispersant, $C_{1-5}$ carboxylic acid, water, carrier and optional solvent, e.g., 0-10%, 0-5% or 0-2% other components are added. In one particular embodiment, no alcohols, amines or phosphorous compounds are added to the reaction mixture.

The obtained dispersion can be stored and used as is. It is also possible to further purify the dispersion by diluting with solvent, such as a light hydrocarbon, and then allowing the product to settle or subject it to centrifuge. Any coarse, large particles will settle out, however, this is typically minimal and is not required in most cases.

The process prevents the formation of a gel and the product obtained is a free flowing dispersion of submicron particles. Dispersed MgO particles with an average particle size of 1 micron or less and an average particle size of 500 nm is typically obtained. Often an average particle size of 1-500 nm, for example, 1-100 or 10-50 nm are obtained and in certain embodiments, an average particle size is 1-20 nm is possible.

Many types and sources of magnesium oxide can be used as a starting material, most frequently, a commercial magnesium oxide in the light or active form is employed. The amount of magnesium oxide used is dependent upon the amount of metal desired in the final product as known in the art.

In the process, there is less than a molar equivalent, relative to MgO, of the dispersant and the $C_{1-5}$ carboxlic acid, often much less than a molar equivalent, but there can be significantly more than a molar equivalent of water added.

For example, in the present invention, the reaction mixture contains at least 8%, typically at least 10% by weight of water, based on the total weight of the mixture, and typically 12% or more. In certain embodiments, the amount of water is comparable by weight to the amount of MgO and in some particular embodiments, the weight of water is higher than the amount of MgO. In terms of molar equivalents relative to MgO, the reaction mixture contains from about a 5:1 to 1:1 molar ratio of water to MgO, for example, from about 3:1 to 1:1. Ratios of from 2.5:1 to 1:1, or from 2:1 to 1:1 are common, such as 1.5, 1.8, 2, 2.2 and 3 molar equivalents of water relative to MgO can be employed. The process can also be used to prepare MgO dispersions starting with $Mg(OH)_2$ instead of MgO, but in that case, less water is typically added.

The $C_{1-5}$ carboxylic acid can be any such acid, for example, acetic acid, propionic acid, butyric acid, pentanoic acid; excellent results have been obtained using acetic acid. A small amount of this acid relative to MgO is employed in the reaction, for example, the molar ratio of MgO to $C_{1-5}$ carboxylic acid is from about 100:1 to 2:1, for example, from about 50:1 to about 5:1, or from about 30 to 1 to 10:1, such as a molar ratio of MgO to $C_{1-5}$ carboxylic acid of about 20:1.

The dispersant is a sulfonic acid or carboxylic acid. Mixtures of dispersants may be used including mixtures of sulfonic acids, mixtures of carboxylic acids or mixtures including both sulfonic and carboxylic acids. Excellent results have been obtained using sulfonic acid dispersants widely known by those skilled in the art as oil-soluble sulfonic acids.

For example, sulfonic acid dispersants be derived from natural petroleum fractions or various synthetically prepared sulfonated compounds. Typical oil-soluble sulfonic acids which may be used include: alkane sulfonic acids, aromatic sulfonic acids, alkaryl sulfonic acids, aralkyl sulfonic acids, petroleum sulfonic acids such as mahogany sulfonic acid, petroleum sulfonic acid, paraffin wax sulfonic acid, petroleum naphthene sulfonic acid, polyalkylated sulfonic acid, and other types of sulfonic acids which may be obtained by fuming sulfuric acid treatment of petroleum fractions. In one embodiment, an alkaryl sulfonic acid, i.e., an alkylbenzene sulfonic acid, is used as dispersant with excellent results.

Carboxylic acid dispersants which may be used in some embodiments are also well known in the art. The carboxylic acid dispersants are not the same as the $C_{1-5}$ carboxylic acid required for the invention as the dispersants have more than 5 carbon atoms, typically much more than 5 carbon atoms. Some examples include, lauric, myristic, palmitic, stearic, isostearic, archidic, behenic and lignoceric acids; aromatic acids such as alkyl salicylic acids. Mixtures of carboxylic acids include commercial grades containing a range of acids, including both saturated and unsaturated acids. Such mixtures may be obtained synthetically or may be derived from natural products, for example, tall, cotton, ground nut, coconut, linseed, palm kernel, olive, corn, palm, castor, soybean, sunflower, herring and sardine oils and tallow.

In many embodiments of the invention, the dispersant is a naturally occurring or synthetic sulfonic acid. Excellent results have been obtained using, for example, alkyated arylsulfonic acids, for example, alkylated benzenesulfonic acids. In general, the sulfonic acid dispersant will have a MW of 300 or higher, often 350 or higher, for example 400 or higher. Mixtures of sulfonic acids may be used, for example, alkylated benzene sulfonic acids may be mono-alkylated, di-alkylated or mixtures of mono- and di-alkylated compounds may be used and in some embodiments, benzene sulfonic acid may be alkylated by alkyl chains of varying lengths. In such cases, the MW is the number average molecular weight. For example, excellent results have been obtained using alkyated benzene sulfonic acids with an average MW of from about 350 to 1000.

In general, a molar ratio of MgO to dispersant of from about 10:1 to 200:1 is employed in the reaction, frequently the ratio is from about 20:1 to 200:1. In certain embodiments the molar ratio of MgO to surfactant is from about 20:1 to 100:1 or from about 25:1 to 50:1.

In many embodiments, the molar ratio of MgO to $C_{1-5}$ carboxylic acid, for example acetic acid, is from about 50:1 to about 5:1 or from 30:1 to10:1 and the molar ratio of MgO to dispersant, for example, an alkylated sulfonic acid, is from about 20:1 to 100:1 or from about 25:1 to 50:1.

The high boiling hydrocarbon carrier is a material or mixture of materials well known in the art with a boiling point of 280° C. or higher, often much higher, for example, mineral oils, oligomers or polymers of alpha olefins, aromatic systems such as polycyclic aromatics and alkylated derivatives thereof, long chain alkanes including waxes and other similar natural or synthetic materials. Obviously, part of the reasoning for choosing a high boiling carrier is that part of the process requires temperatures of 280° C. and higher.

Often, an inert organic solvent with a boiling point below 280° C. is also added to the reaction mixture. The presence of lower boiling solvents can be used to make the reaction mixture more fluid and stirrable, especially if very low amounts of carrier hydrocarbon are used. An inert solvent is a solvent which does not interfere with the overbasing process. For example, well known aliphatic or aromatic hydrocarbons with boiling points ranging from about 80° C. to about 240° C., for example, boiling points ranging from about 80° C. to about 220° C. and mixtures thereof are conveniently used, including linear and cycloaliphatic compounds such as octanes, decanes etc, and aromatic hydrocarbons such as xylene, mesitylene, ethylbenzene, butyl benzenes, tetralin and the like. Lower boiling solvents are optional and are readily removed, if desired, by distillation once the process reactions are complete.

In the process, each of the components are mixed together, typically under ambient conditions, i.e., room temperature and atmospheric pressure, and then heated with stirring or other agitation under reflux until the water, acid and dispersant bring the MgO into a uniform, light suspension. The temperature is then raised to 280-360° C., typically temperatures of 300-340° C. are reached, and the water is removed, e.g., via Dean Stark trap. Heating and mixing are continued until all the water is removed, the amount of water collected is measured to ensure completion, and the mixture is allowed to cool.

In some embodiments, some of the water is removed at temperatures lower than 280° C., but full reaction and removal of all water is best completed at temperatures above 280° C., for example 300-340° C. For example, upon combining all components, the mixture may be stirred at about 100° C. to obtain an appropriate initial suspension and then heated to an intermediate temperature, e.g., between 120 and 220° C. during which time water is removed, and then the reaction mixture is heated to 280-360° C. to ensure complete reaction and removal of water.

The product of the process and the process itself represent embodiments of the invention. While molar ratios cited above describe aspects of the invention, the practical aspects of the invention are more fully defined by physical amounts, i.e., weight, of the individual components used. Thus, a general process for carrying out many embodiments of the invention is as follows, percentages unless otherwise stated are weight percent based on the weight of total of the mixture or composition:

a mixture of 2-15% of a dispersant having a MW of 300 or higher, for example an alkylbenzene sulfonic acid, 5-40% of MgO, 8%-30% of water, 1-10% of a carboxylic acid, e.g., acetic acid 10-70% of a high boiling hydrocarbon carrier 0-60% of an organic solvent with a boiling point below 280° C., for example a boiling point ranging from about 80° C. to about 210° C., for example xylene or mesitylene, is stirred and heated under reflux for 0.25 to 5 hours, typically 0.5 to 4 hours, for example 1 to 3 hours, and then heated to over 280° C., typically between 300 and 360° C., for example, 300-340° C. The temperature remains above 280° C. until all the water is removed and the resulting mixture is allowed to cool yielding the inventive dispersion. The product produced by the inventive process comprises the MgO/dispersant product and high temperature hydrocarbon carrier and is bright and clear with very little to no sediment.

The optional organic solvent may be removed by distillation if desired. It is also possible to remove some of the high boiling carrier if desired, in which case distillation under reduced pressure may provide advantages.

In one embodiment, the overbased magnesium oxide dispersion is produced from a mixture of MgO, a mixture of alkylated benzene sulfonic acids such as a mixture comprising benzene sulfonic acids substituted with alkyl chains of from 14 to 24 carbon atoms, e.g., 18 to 24 carbon atoms, acetic acid, water and an optional aromatic solvent such as xylene or mesitylene using a light natural oil, an alkylated benzene or mixture of alkylated benzenes, or alpha olefin oligomers as carrier, for example, a mixture of oligomers of 1-decene.

For example, the process may be carried out as follows:

2-10%, for example 3-10%, for example 3-7% of a dispersant, for example an alkylbenzene sulfonic acid, 5-40%, typically 10-40%, for example 10-25% of MgO, 10%-20%, for example, 12-20% or 12-18% water 1-10%, for example 1-7%, for example 2-5% of a carboxylic acid, e.g., acetic acid 10-40%, for example 15-30%, of a high boiling hydrocarbon carrier 20-60% for example 25-50%, for example 30-45% of an organic solvent with a boiling point ranging from about 80° C. to about 210° C., for example xylene or mesitylene, is stirred and heated under reflux for 0.25 to 5 hours, typically 0.5 to 3 hours and then heated to over 280° C., typically between 300 and 360° C., for example, 300-340° C. The temperature remains above 280 until all the water is removed and the resulting mixture is allowed to cool yielding the inventive dispersion.

In another example, the process is carried out as follows:

2-15%, for example 4-10%, for example 5-10% of a dispersant having a MW of 300 or higher, for example an alkylbenzene sulfonic acid, 10-40%, for example, 10-35%, for example 15-30% of MgO, 8%-30%, for example, 10-20% or 12-18% water 1-10%, for example 1-5%, for example 1-4% of a carboxylic acid, e.g., acetic acid 10-70%, for example 30-60%, for example 40-55%, of a high boiling hydrocarbon carrier 0-30%, for example 0-10%, for example 5-10%, of an organic solvent with a boiling point below 280° C., for example a boiling point ranging from about 80° C. to about 210° C., for example xylene or mesitylene, is stirred and heated under reflux for 0.25 to 5 hours, typically 0.5 to 4 hours, for example 1 to 3 hours, and then heated to over 280° C., typically between 300 and 360° C., for example, 300-340° C. The temperature remains above 280° C. until all the water is removed, and the organic solvent is distilled off, and the resulting mixture is allowed to cool yielding the inventive dispersion. The product produced by the inventive process comprises the MgO/dispersant product and high temperature hydrocarbon carrier and is bright and clear with very little to no sediment.

The reaction components need not be added to the reactor simultaneously. For example, in one embodiment the MgO is added first with mixing to the carrier and optional solvent, followed by dispersant and water, and the carboxylic acid is added last. There may be more than two heating stages, for example, in one embodiment the components are mixed at temperatures of 50 to 150° C. for 1 to 3 hours, the temperature is then raised, for example to temperatures higher than 150° C., such as 155 to 220° C., while removing excess water and solvent, and then after the excess water and solvent is removed, the reaction is heated to temperatures in excess of 280° C., typically between 300 and 360° C., and held until all water is removed. Excess carrier may also be removed at this point but much of the carrier that distills over with the water is returned to the reaction vessel by using, for example, a liquid/liquid extractor or dean stark apparatus.

The invention is very valuable for the production of MgO dispersions in a high boiling hydrocarbon carrier wherein the wt % of magnesium is greater than 14%, for example, dispersions wherein the wt % of magnesium is 20% or higher. In a particular embodiment, MgO dispersions comprising 20-40% magnesium are prepared such as those containing about 30-35% magnesium.

The overbased magnesium containing dispersion can be used as an additive in fuels, lubricating oils, anti corrosive paints and as part of any formulation containing similar materials. For example, the dispersion is used as an additive in petroleum based lubricants and fuels. The typical uses and dose levels are found in the art cited above, additional additive art not previously cited such as U.S. Pat. No. 4,094,801, incorporated herein in its entirety by reference, standard texts and other commercial literature. For example, when used as a lubricant additive, the product of the inventive process is added in an amount of 1-40%, for example 1-20%, and typically at least 2% or 5% by weight based on the amount of magnesium present in the final composition. Less is typically added to fuels; for example less than 2% and typically less than 1%, for example 1-2,000 ppm often 1-1,000 ppm or 1-100 ppm by weight based on the amount of magnesium present in the final composition. When part of a fuel, lubricating oil or other commercial composition, other standard additives common to fuels or lubricants will obviously also be present.

Once the dispersion is prepared, the product of the present invention can be further processed if desired, or additional materials such as co-additives such as other dispersants, buffers etc, solvents, oils and the like can be added.

EXAMPLES

Example 1

To a 500 mL 3-neck round bottom flask is charged 29.3 grams of MgO (98%), 12.0 grams of an alkylated benzene sulfonic acid dispersant, 50.0 grams of PAO-4 (a mixture of 1-decene oligomers), 100.0 grams of Xylene, 30.0 grams of water, and 6.2 grams of glacial acetic acid. The mixture is then stirred and heated to reflux for 1 hr after which time the mixture was further heated to 350° C. using Dean-Stark trap to remove all water and return any oil that is distilled off. The resulting product is cooled down to room temperature; it is bright and clear with very little sediment, yield ~99% according to the weight obtained and theoretical weight. The Mg % is about 18 weight %.

Example 2

The procedure of Example 1 is repeated using a different alkylated benzene sulfonic acid dispersant to obtain a bright, clear dispersion with very little sediment, yield ~99% according to the weight obtained and theoretical weight and the Mg % is about 18 weight %.

Example 3

To a 500 mL 3-neck round bottom flask is charged 45.3 grams of MgO (98%), 16.0 grams of the sulfonic acid dispersant of Ex 2, 37.0 grams of PAO-4 (a mixture of 1-decene oligomers), 100.0 grams of Xylene, 30.0 grams of water, and 7.0 grams of glacial acetic acid. The mixture is then stirred and heated to reflux for 1 hr after which time the mixture was further heated to 350° C. using Dean-Stark trap to remove all water and return any oil that is distilled off. The resulting product is cooled to room temperature; it is bright and clear with very little sediment, yield ~99% according to the weight obtained and theoretical weight. The Mg % is about 26 weight %.

Example 4

Under a nitrogen atmosphere at 4 psig, 22000 kg of a mixture of $C_{10-13}$ alkylated benzene distillation bottom and 2200 kg of xylenes are mixed and 8000 kg of MgO added under agitation for 15 minutes. 3100 kg of a mixture of $C_{6-24}$alkylated benzene sulfonic acid is added with agitation to disperse, 5300 kg of deionized water is then added, followed by 880 kg of acetic acid. The resulting mixture is heated to 100° C. under full agitation for 2-3 hrs and then heated to 200° C. to remove water and xylene. The temperature is then raised to 330° C. and distilled until no more water is collected with alkylated benzenes being returned to the reaction vessel via a liquid/liquid extractor. Vacuum is gradually applied to 50 mmHg to concentrate the reaction mixture slightly to a Mg content of 33%, the product is cooled and diluted with #2 fuel to achieve 30% Mg content, and filtered.

What is claimed:

1. A stable, free flowing overbased magnesium oxide dispersion in a high boiling hydrocarbon carrier with a magnesium content of 25-35% by weight based on the total weight of the dispersion, prepared by heating at reflux a mixture comprising 2-10% of an-alkylbenzene sulfonic acid dispersant having a MW of 300 or higher, 10-40% of MgO, 10%-20% water 1-10% of the $C_{1-5}$ carboxylic acid, 10-70% of a hydrocarbon carrier having a boiling point of 280° C. or higher selected from mineral oils, alkylated benzenes, oliqomers or polymers of alpha olefins, polycyclic aromatics, alkylated derivatives of polycyclic aromatics and waxes, 5-60% of an alkylated aromatic organic solvent with a boiling point ranging from about 80° C. to about 210° C.

for 0.25 to 5 hours, followed by heating to an elevated temperature of 280-360° C. until all water is removed wherein no acidic gas is passed through the mixture of MgO, dispersant, $C_{1-5}$ carboxylic acid , water, hydrocarbon carrier having a boiling point of 280° C. or higher and an alkylated aromatic organic solvent with a boiling point ranging from about 80° C. to about 210° C.

2. A process for preparing a stable, free flowing overbased magnesium oxide dispersion in a high boiling hydrocarbon carrier with a magnesium content of 15-40% by weight based on the total weight of the dispersion, comprising heating at reflux a mixture comprising 2-15% of an alkylbenzene sulfonic acid dispersant having a MW of 300 or higher, 5-50% of MgO, 8-30% of water, 1-10% of a $C_{1-5}$ carboxylic acid, 10-70% of a hydrocarbon carrier having a boiling point of 280° C. or higher,selected from mineral oils, alkylated benzenes, oligomers or polymers of alpha olefins, polycyclic aromatics, alkylated derivatives of polycyclic aromatics and waxes, 5-60% of an alkylated aromatic organic solvent with a boiling point ranging from about 80° C. to about 210° C., for 0.25 to 5 hours, followed by heating to an elevated temperature of 280-360° C. until all water is removed, wherein no acidic gas is passed through the mixture of MgO, dispersant, $C_{1-5}$ carboxylic acid , water, hydrocarbon carrier having a boiling point of 280° C. or higher and an alkylated aromatic organic solvent with a boiling point ranging from about 80° C. to about 210° C.

3. The process according to claim 2 for preparing a MgO dispersion having a magnesium content of from about 20 to about 40%, which comprises heating at reflux a mixture comprising 3-10% of the alkylbenzene sulfonic acid, 10-40% of MgO, 12-20% water, 1-7% of the $C_{1-5}$ carboxylic acid, 15-30% of the hydrocarbon carrier having a boiling point of 280° C. or higher, 25-50%, of an alkylated aromatic organic solvent with a boiling point ranging from about 80° C. to about 210° C., followed by heating to an elevated temperature of 280-360° C. until all water is removed.

4. The process according to claim 2 for preparing a MgO dispersion having a magnesium content of from about 20 to about 40%, which comprises heating at reflux a mixture comprising 5-10% of the alkylbenzene sulfonic acid, 15-30% of MgO, 12%-20% water, 1-4% of the $C_{1-5}$ carboxylic acid, 40-60% of the hydrocarbon carrier having a boiling point of 280° C. or higher, 5-10%, of an alkylated aromatic organic solvent with a boiling point ranging from about 80° C. to about 210° C., followed by heating to an elevated temperature of 280-360° C. until all water is removed.

5. The process according to claim 2 wherein the $C_{1-5}$, carboxylic acid is acetic acid.

* * * * *